US006213337B1

(12) United States Patent
Kamperman et al.

(10) Patent No.: US 6,213,337 B1
(45) Date of Patent: Apr. 10, 2001

(54) METAL BODY FOR PACKAGING PURPOSES, FOR EXAMPLE A FOOD CAN

(75) Inventors: Stephanus Maria Kamperman, Doesburg; Peter Gerard van Herrewegen, Amsterdam, both of (NL)

(73) Assignee: Corus Staal BV, CA IJmuiden (NL)

( * ) Notice: Subject to any disclaimer, the term of this patent is extended or adjusted under 35 U.S.C. 154(b) by 0 days.

(21) Appl. No.: 09/485,455

(22) PCT Filed: Aug. 11, 1998

(86) PCT No.: PCT/EP98/05128

§ 371 Date: May 5, 2000

§ 102(e) Date: May 5, 2000

(87) PCT Pub. No.: WO99/08940

PCT Pub. Date: Feb. 25, 1999

(30) Foreign Application Priority Data

Aug. 20, 1997 (NL) ..... 1006809

(51) Int. Cl.[7] ..... B65D 1/02
(52) U.S. Cl. ..... 220/669
(58) Field of Search ..... 220/669, 670, 220/671, 674, 675; 215/382, 398

(56) References Cited

U.S. PATENT DOCUMENTS

| | | | | |
|---|---|---|---|---|
| 1,262,289 | | 4/1918 | Weber . | |
| 1,268,582 | * | 6/1918 | Know | 220/669 |
| 1,423,419 | * | 7/1922 | Halaska | 220/669 |
| 2,340,473 | * | 2/1944 | Johnson | 220/669 |
| 3,563,408 | | 2/1971 | Bijvoet . | |
| 5,715,968 | * | 2/1998 | Fink et al. | 220/669 |
| 5,833,115 | * | 11/1998 | Eiten | 220/669 |

FOREIGN PATENT DOCUMENTS

| | | |
|---|---|---|
| 2165139 | 7/1972 | (DE) . |
| 0097399 | 1/1984 | (EP) . |
| 1325085 | 7/1963 | (FR) . |

* cited by examiner

*Primary Examiner*—Joseph M. Moy
(74) *Attorney, Agent, or Firm*—Stevens, Davis, Miller & Mosher, L.L.P

(57) ABSTRACT

Metal body for packaging purposes comprising a closed metal shell extending around a longitudinal axis which is suitable for being provided on a side named here as the top with a lid running essentially perpendicular to the longitudinal axis. A transverse cross section through the shell on and close to the top has a contour comprising $3 \leqq n \leqq 6$ contour line pieces that are curved concavely inwards with a minimum radius of curvature R, and n essentially straight contour line pieces. The shell also comprises at least n essentially flat shell parts, which are separated from one another by a sharp fold running essentially parallel to the longitudinal axis, which fold has a maximum radius of curvature r, whereby $r \leqq 0.4$ R.

18 Claims, 4 Drawing Sheets

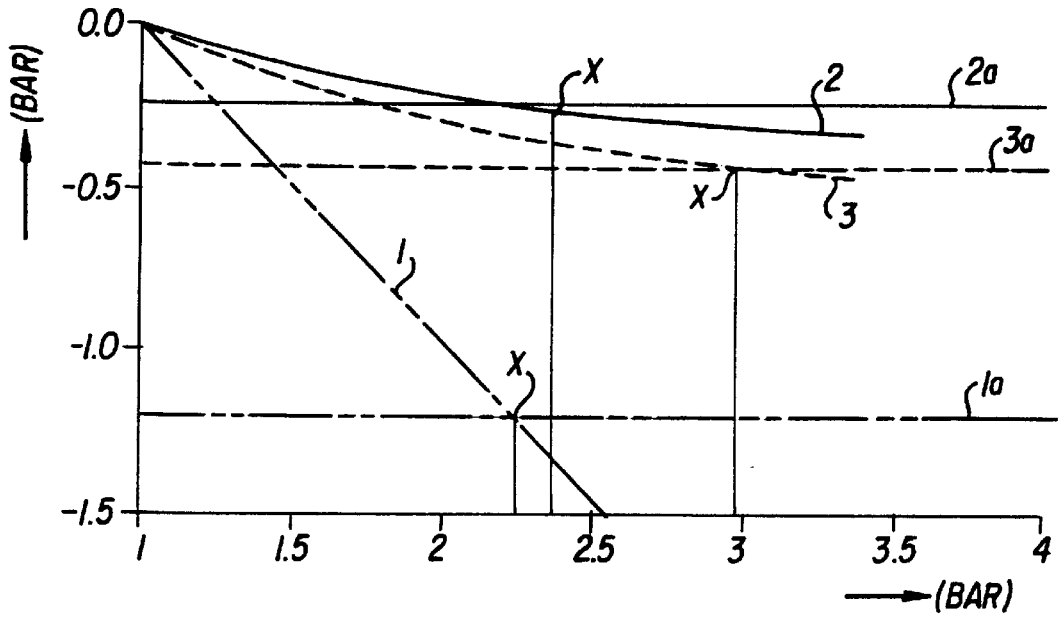
FIG. 6
FIG. 7
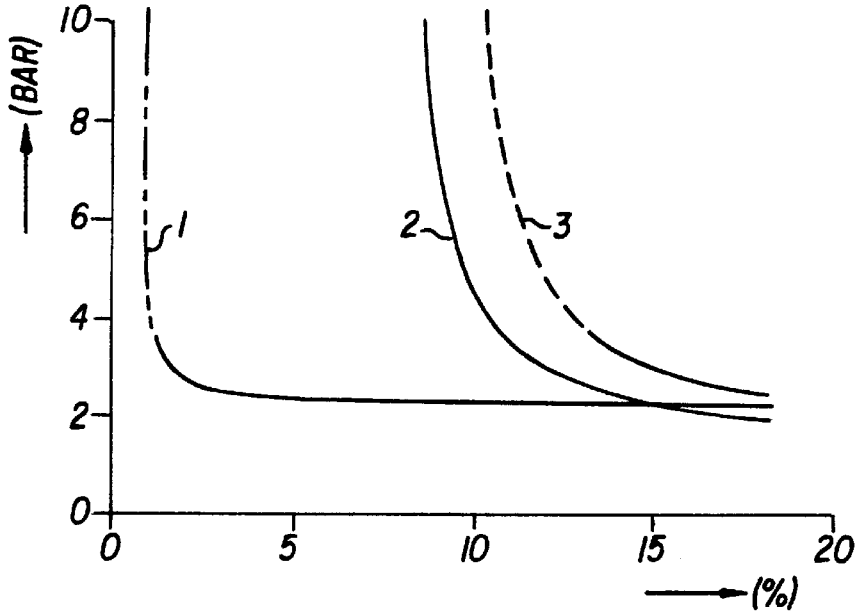

METAL BODY FOR PACKAGING PURPOSES, FOR EXAMPLE A FOOD CAN

FIELD OF THE INVENTION

The invention relates to a metal body for packaging purposes comprising a closed metal shell extending around a longitudinal axis which is suitable for being provided on a side named here as the top with a lid running essentially perpendicular to the longitudinal axis, the shell comprising n essentially flat shell parts.

BACKGROUND OF THE INVENTION

Such a body is known for example as a component of a packaging container, for example a food can, see U.S. Pat. No. 3,563,408.

In U.S. Pat. No. 3,563,408 a container is diclosed with a central prismatic body portion which is linked at each end to a circular opening.

Besides its body, a three-piece packaging container comprises a base and a lid. With a two-piece packaging container the body and base are in one piece.

Also known is a conventional packaging container which is circular cylindrical, possibly provided with beads running essentially parallel to the lid face, or 'blown up' in a somewhat bulging shape.

Also known is a packaging container of an essentially circular cylindrical shape which has finger-shaped panels curved convexly inwards and extending up the height of the wall.

SUMMARY OF THE INVENTION

The object of the invention is to create a lightweight packaging container, which, while also breaking away from the conventional circular cylindrical shaped appearance and improving the stiffness, achieves advantages discussed below in more detail.

To this end the body in accordance with the invention provides a metal body for packaging purposes comprising a closed metal shell 100 extending around a longitudinal axis 102 which is suitable for being provided on a side named here as a top 104 with a lid 106 running essentially perpendicular to the longitudinal axis 102. The shell 100 comprises essentially flat shell parts 110, 112, wherein a transverse cross-section through the shell at the top and close to the top has a contour comprising alternately n contour line pieces 120 (FIG. 3A) that are curved concavely inwards with a minimum radius of curvature R, and n essentially straight contour line pieces (a portion of which is shown as element 122 in FIG. 3A), wherein $3 \leqq n \leqq 6$. The shell 100 comprises at least 2n essentially flat shell parts 110, 112, which are separated from one another by a sharp fold 130 running essentially parallel to the longitudinal axis 102, which fold 130 has a maximum radius of curvature $r \leqq 0.4$ R. As shown in FIG. 1, flat shell part 110 has a width W1 and flat shell part 112 has a width W2. In this context an essentially flat shell part shall be held to comprise a shell part that is slightly convex or slightly concave or that comprises one or more inwardly and/or outwardly protruding terraces.

Here it is preferable that $R \geqq 15$ mm and $r \leqq 5$ mm.

In a particular embodiment the flat shell parts run essentially parallel to the straight contour line pieces.

The body has for example 2n essentially flat shell parts and preferably 2n sharp folds. The body then appears as illustrated in FIG. 1 wherein n equals 4.

It is now possible to work a method for heat treating, for example sterilising a filled can comprising a body in accordance with the invention, whereby a pressure $P_{amb}$ is exerted on the can and a pressure $p_{can}$ prevails in the can, whereby $\Delta p = p_{can} - p_{amb}$, and $p_1 < \Delta p < p_2$, characterised in that $p_1 <<< p_{1\ ref..}$ and $p_2 \leqq p_{2\ ref..}$, where $p_{1\ ref..}$ and $p_{2\ ref..}$ represent respectively the minimum and maximum $\Delta p$ for a conventional reference can.

It is found that when the can in filled state with a body in accordance with the invention is heat treated in an autoclave, it needs to be handled far less critically in terms of pressure. The external pressure on the can may be set far higher and does not need to be reduced accurately on cooling.

The invention is also embodied in a gas-tight can filled with non carbonated drink or food, such as vegetables, fruit, pet food, fish, meat or soup, comprising a metal body in accordance with the invention, preferably a can of packaging steel, whereby the material thickness of the packaging steel of which the body is made is thinner than 0.16 mm. It is even possible to use sterilisable cans in accordance with the invention which are manufactured with a thickness of less than 0.15 mm, 0.14 mm, 0.13 mm or even less than 0.12 mm.

BRIEF DESCRIPTION OF THE DRAWINGS

The invention will now be illustrated by reference to the drawing, in which

FIG. 6 shows the relation between the autoclave pressure and $\Delta p$ as defined;

FIG. 7 shows the relation between the maximum autoclave pressure that can be borne by various shapes of filled cans and different degrees of filling of the cans.

DETAILED DESCRIPTION OF THE PREFERRED EMBODIMENTS

Figure 1:
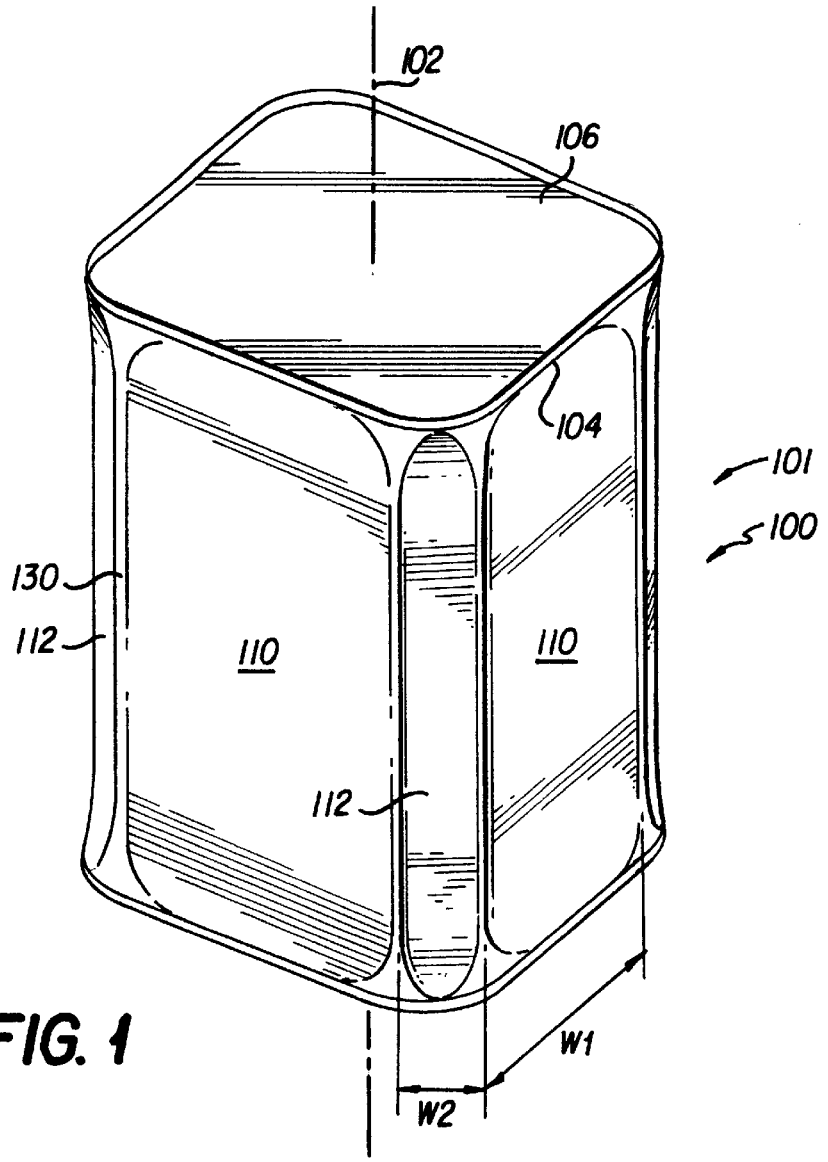
FIG. 1 shows a square tall can in accordance with the invention.

FIG. 1 shows a can 101 in accordance with the invention with a content and height corresponding to a circular cylindrical food can 201 of 73 mm diameter and 110 mm height.

Figure 2:
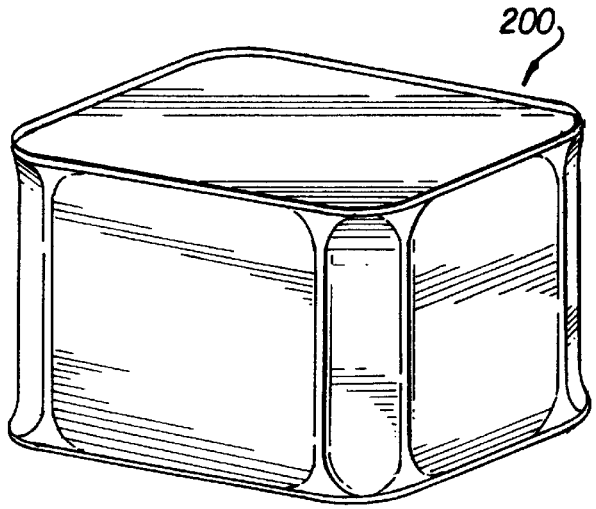
FIG. 2 shows a square short can in accordance with the invention.

The can may also be designed differently, for example shorter as shown in FIG. 2.

Figure 3:
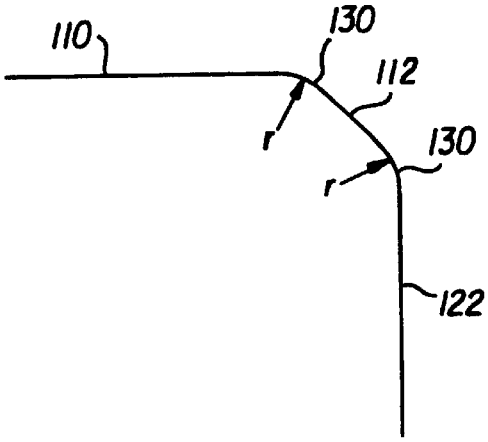
FIG. 3 shows a cross-section of the can of FIG. 3A.
Figure 3A:
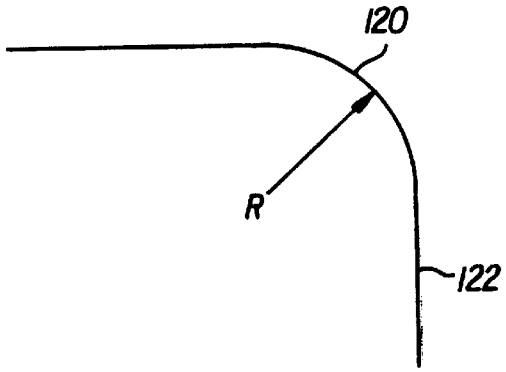
FIG. 3A shows a cross-section of a can in accordance with the invention at and close to the top; at a slight distance from the top.

In FIG. 3A R indicates the curvature of radius of the curved contour line pieces 120 and the top of the shell of the can in accordance with the invention, and FIG. 3 indicates r is the curvature of radius which the shell has at a fold.

The can in accordance with the invention, for example as shown in FIGS. 1, 2 and 3, has the advantage that for the same content it takes up less space than the conventional circular cylindrical can, something which is of great importance on shop shelves or in the distribution chain.

The can in accordance with the invention has for example a width/depth of approx. 66 mm and a height of 110 mm, while at that height the conventional can has a diameter of approx. Ø 73 mm. Consequently for the same filled content, the can in accordance with the invention takes up some 20% less space when being placed in rows than the known circular cylindrical can.

Furthermore, the can in accordance with the invention has less weight in packaging material than the conventional can. For the dimensions cited the conventional can weighs around 50 grams, while the can in accordance with the invention weighs about or even less than 40 grams.

Because, with a difference Δp between the pressure in the can $P_{can}$ and the ambient pressure $P_{amb}$, the (filled) can in accordance with the invention can deform more than the conventional can, the content is able to support the can even under a high external pressure (negative Δp) without the can collapsing, which in practice offers great advantages as described later. Also in case of a high internal pressure the flexibility of the can according to the invention compensates pressure differences. This has the effect that conventional sterilisation procedures suffice.

During the sterilisation process the pressure in the can changes as a consequence of the temperature changes. This change in pressure in the can must be compensated by a change in pressure in the surroundings of the can in order to stop the can bursting apart or collapsing into itself. In general during the sterilisation process this ambient pressure (autoclave pressure) is kept controlled.

If the temperature and pressure in the can is not able to follow the fall in temperature and pressure in the surroundings quickly enough, the can may permanently deform or collapse outwards. Then the most common deformation is the lid bulging out.

A can collapsing inwards occurs when the temperature and pressure in the can have dropped, while the pressure in the autoclave is still high. The known round, usually ribbed food can then collapses inwards in 3, 4, 5 or more sides.

During the cooling process the risk of the can deforming outwards (bursting apart) changes to the can deforming inwards (collapsing inwards). This means that during cooling the pressure in the surroundings of the known can must be allowed to reduce gradually.

In practice controlling this ambient pressure proves difficult.

This is because, depending on the local conditions, position and orientation, there are differences in pressure in the cans due to differences in heating/cooling rates of the cans. At present collapsing is overcome by imposing high demands on the mechanical strength of the can. For example, the known Ø 73×110 mm food can must be able to withstand a pressure difference Δp from $p_{1\ ref.}$=−1.2 bar up to $p_2$=1.75 bar without permanently deforming. The working range for Δp extends from $p_{1\ ref.}$ to $p_{2\ ref.}$. Where $\Delta p<p_{1\ ref.}$ the known can will then collapse inwards, where $\Delta p>p_{2\ ref.}$ that can will then burst.

With the can in accordance with the invention the relationship between the pressure difference in the can and the expansion volume is far more flexible than with a conventional reference food can. This has a number of advantages.

Firstly as long as the can is filled leaving a head space of a certain max. amount there is no risk of the can collapsing inwards. With conventional cans there is a risk of the walls of the can collapsing inwards in the case that $\Delta p>p_1$.

To prevent this the wall of the known can has its bending stiffness increased by beads being placed around the circumference and material of adequate thickness is used, for example of over 0.16 mm for a Ø 73×110 mm food can. With the flexible can its potential to expand is such that the overpressure outside it can be borne by the content of the can and no longer by the side wall of the can. The can in accordance with, the invention can withstand a very high external overpressure. For the can in accordance with the invention it is no longer necessary to place demands on the stiffness (thickness, beads) of the can wall to prevent the can wall from collapsing inwards. Consequently the working range of this can is a good deal greater. In practice this means that the pressure control of the autoclave is far easier to achieve. As long as the pressure in the autoclave is higher than the pressure in the can nothing can go wrong.

Figure 4:
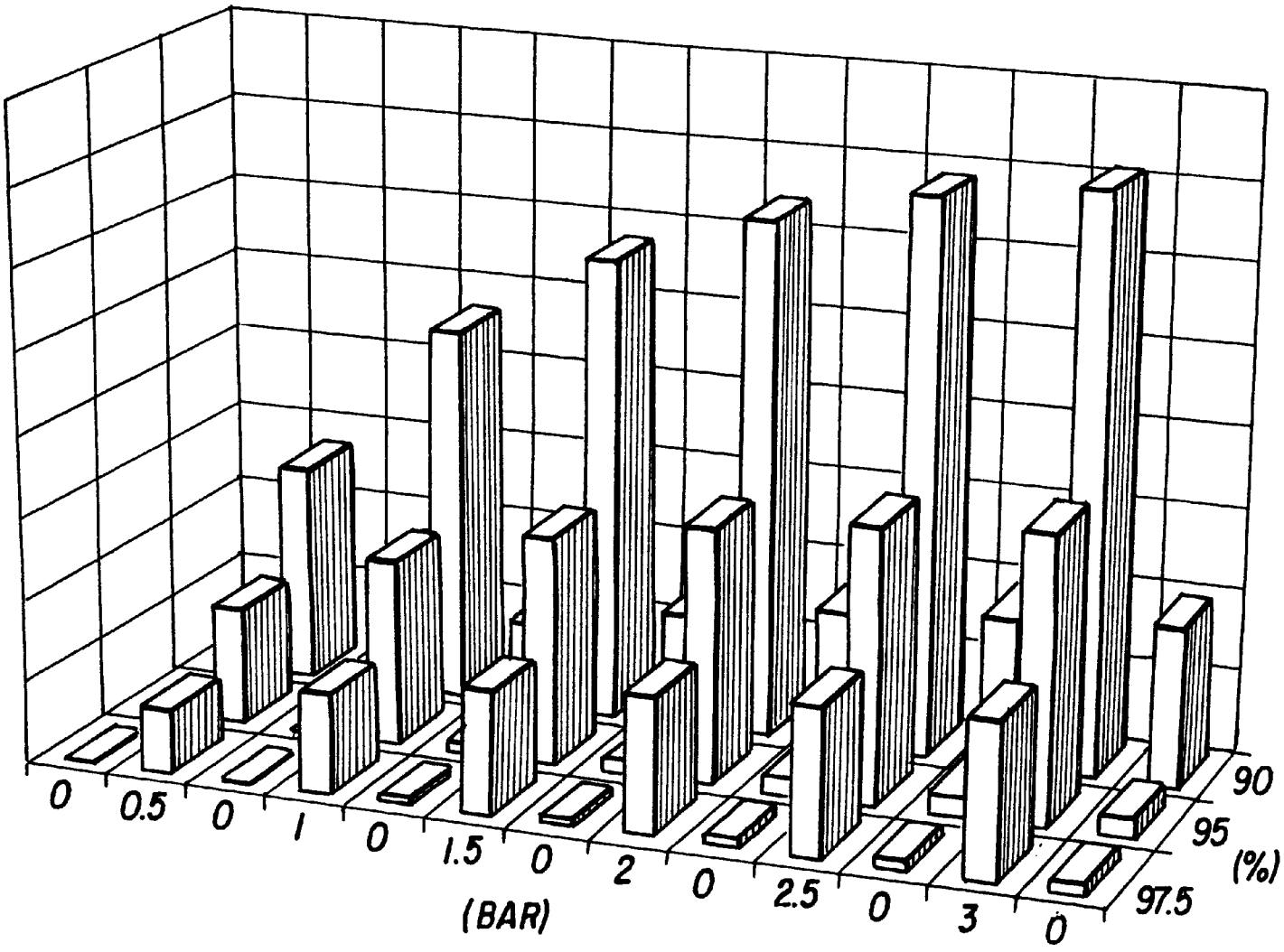
FIG. 4 shows the deformation of the (filled) can in accordance with the invention as a consequence of the external pressure at different stages of can filling.

FIG. 4 gives the results of several experiments, whereby cans in accordance with the invention were filled by fully topping them up with water of 80° C. on a pair of scales, and, in order to create some headroom, 2.5%, 5% and 10% water was removed respectively. The cans filled in this manner to the extent of filling of 90%, 95% and 97.5% were then closed and after cooling to room temperature in a pressure chamber they were tested for deformation behaviour.

FIG. 4 represents vertically, the deformation of a side wall of the can, and horizontally the external pressure in bars, and at the rear the extent of filling expressed in percent. During testing an exertion of overpressure increasing in stages by 0.5 bar (0.5 . . . 3 bar) was alternated with an atmospheric pressure (0 bar). It is clear to see that with a higher extent of filling of over 95% the permanent deformation is drastically less than with a lower extent of filling.

Therefore, with the can in accordance with the invention a great part of the external loading is as it were borne by the contents, so that less demanding requirements need to be imposed on the can itself.

Because the can has this greater potential to expand, the headroom in the can may be reduced. This means that the can in accordance with the invention can contain more food, and that the risk of perishing as a consequence of oxygen inclusion is reduced.

Thirdly it is no longer necessary to place horizontal beads in the can wall, which increases the axial strength of the can. Axial strength is necessary in order to prevent damage to a can during processing, for example when flanging and closing and during transport. This also has the advantage that the product designation, for example a label or printing can take place more easily and offers a more attractive appearance. Lastly it is now possible to use even thinner material for the can wall.

Figure 5:
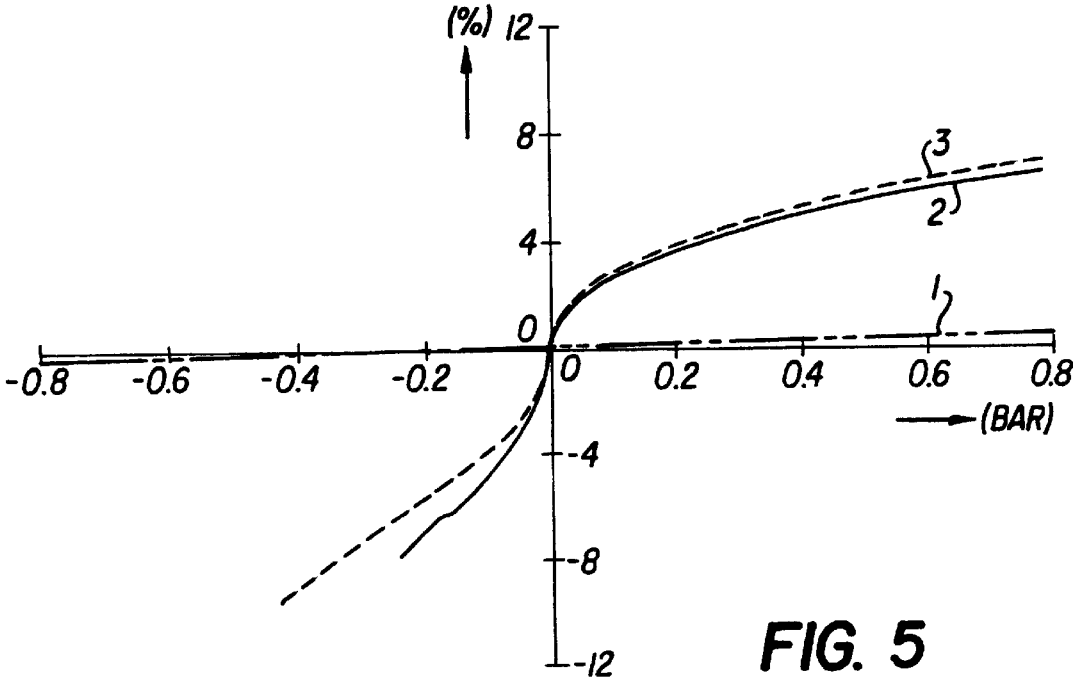
FIG. 5 shows the flexibility of various shapes of cans including the cans in accordance with the invention.

In FIGS. 5, 6 and 7 various properties of different shapes of cans have been illustrated in diagrams. With dash-dotted lines, further indicated with reference numerals 1, properties of conventional cans with a diameter of approximately Ø 73 mm and a height of 110 mm have been illustrated. The drawn lines, indicated with reference numerals 2, relate to cans of similar height but with a square cross-section with width and depth of approximately 66 mm and with rounded corners with a curvature R as shown in FIG. 3. The dotted lines, indicated with reference numerals 3, relate to cans of similar height but with a square cross-section with width and depth of approximately 66 mm and with flattened corners as shown in the lower part of FIG. 3.

FIG. 5 illustrates the flexibility of these cans. Along the horizontal axis the pressure change in bar excerted on the cans is shown and along the vertical axis the relative change in volume in %. All cans were closed but empty. Apparently the can with the flattened corners (3) combines a high flexibility with an increased implosion performance.

FIG. 6 illustrates the failure of cans under various pressure conditions in an autoclave, indicated along the horizontal axis in absolute pressure in the autoclave in bars. All cans had been filled up to a free head space of 5% of the can contents. Along the vertical axis the pressure difference $\Delta p$ ($=p_{can}+p_{amb}$) over the can body has been indicated. The horizontal lines with reference numerals 1*a,* 2*a* and 3*a* illustrate the strength of the circular-cylindrical cans, the square cans with rounded corners and the square cans with flattened corners per se. The known Ø 73×110 mm can 1 shows a nearly linear relation of $\Delta p$ with the absolute autoclave pressure. At the intersection x of lines 1 and 1*a* the can will fail and will implode. Similarly at the intersections of lines 2 and 2*a,* respectively of lines 3 and 3*a* the square cans with rounded corners and the square cans with flattened corners will fail and will implode. In the case of the circular-cylindrical can the autoclave pressure is fully responsible for a high difference between the inside can pressure and the autoclave pressure. The pressure difference $\Delta p$ is fully borne by the can wall. Contrary thereto the relation is strongly non-linear for filled non-circular cans. As a result of the volume change in the can, the autoclave pressure is partly borne by the stiffness of the can body and partly borne by a pressure increase in the headspace. It can be concluded that the mentioned can with flattened corners resists a higher autoclave pressure than existing circular and non-circular cans. This enables the use of much thinner material for the can body.

FIG. 7 represents along the vertical axis the maximal autoclave pressure in bars that can be borne by the filled can for different headspaces indicated in %. It appears that for practical headspaces between 2 and 15% the can with flattened corners resists extremely high autoclave pressures. It can be concluded that implosion of the mentioned can with flattened corners is very unlikely (line 3).

We claim:

1. A metal body for packaging purposes comprising:

a closed metal shell extending around a longitudinal axis which is suitable for being provided on a side named here as a top with a lid running essentially perpendicular to a longitudinal axis of the shell, the shell comprising essentially flat shell parts, wherein a transverse cross-section through the shell at the top and adjacent the top has a contour comprising alternately n contour line pieces that are curved concavely inwards with a minimum radius of curvature R, and n essentially straight contour line pieces, wherein $3 \leqq n \leqq 6$, wherein at least 2n said essentially flat shell parts are separated from one another by a fold running essentially parallel to the longitudinal axis, which fold has a maximum radius of curvature $r \leqq 0.4$ R.

2. Body in accordance with claim 1, whereby $R \geqq 15$ mm.

3. The metal body in accordance with claim 1, whereby $r \leqq 5$ mm.

4. The metal body in accordance with claim 1, wherein the flat shell parts run essentially parallel to the straight contour line pieces.

5. A gas-tight can filled with non carbonated drink or food, selected from the group consisting of vegetables, fruit, pet food, fish, meat and soup, comprising a metal body in accordance with claim 1.

6. The gas-tight can in accordance with claim 5 of packaging steel, where in the material thickness of the packaging steel from which the body is made is thinner than 0.16 mm.

7. The metal body in accordance with claim 1, wherein adjacent said essentially flat shell parts separated by a respective said fold differ from each other in their respective width.

8. The metal body in accordance with claim 2, whereby $r \leqq 5$ mm.

9. The metal body in accordance with claim 2, wherein the flat shell parts run essentially parallel to, the straight contour line pieces.

10. The metal body in accordance with claim 3, wherein the flat shell parts run essentially parallel to the straight contour line pieces.

11. A gas-tight can filled with non carbonated drink or food, selected from the group consisting of vegetables, fruit, pet food, fish, meat and soup, comprising a metal body in accordance with claim 2.

12. A gas-tight can filled with non carbonated drink or food, selected from the group consisting of vegetables, fruit, pet food, fish, meat and soup, comprising a metal body in accordance with claim 3.

13. A gas-tight can filled with non carbonated drink or food, selected from the group consisting of vegetables, fruit, pet food, fish, meat and soup, comprising a metal body in accordance with claim 4.

14. A metal body for packaging purposes comprising:

a closed metal shell extending around a longitudinal axis which is suitable for being provided on a side named here as a top with a lid running essentially perpendicular to a longitudinal axis of the shell, the shell comprising essentially flat shell parts, wherein a transverse cross-section through the shell at the top and adjacent the top has a contour comprising alternately n contour line pieces that are curved concavely inwards with a minimum radius of curvature R, and n essentially straight contour line pieces, wherein $3 \leqq n \leqq 6$, and wherein at least n said essentially flat shell parts are separated from one another by a fold running essentially parallel to the longitudinal axis, which fold has a maximum radius of curvature $r \leqq 0.4$ R.

15. The metal body of claim 14, wherein there are 2n said essentially flat shell parts and 2n said folds.

16. The metal body in accordance with claim 14, wherein adjacent said essentially flat shell parts separated by a respective said fold differ from each other in their respective width.

17. A gas-tight can filled with non carbonated drink or food, selected from the group consisting of vegetables, fruit, pet food, fish, meat and soup, comprising a metal body in accordance with claim 15.

18. The gas-tight can in accordance with claim 15 of packaging steel, wherein the material thickness of the packaging steel from which the body is made is thinner than 0.16 mm.

* * * * *